US008876030B2

(12) United States Patent
Hubrich et al.

(10) Patent No.: US 8,876,030 B2
(45) Date of Patent: Nov. 4, 2014

(54) MOBILE CRUSHER

(75) Inventors: Frank Hubrich, Dresden (DE); Dieter Hoffmann, Leipzig (DE)

(73) Assignee: TAKRAF GmbH, Leipzig (DE)

( * ) Notice: Subject to any disclaimer, the term of this patent is extended or adjusted under 35 U.S.C. 154(b) by 461 days.

(21) Appl. No.: 13/262,294

(22) PCT Filed: Apr. 3, 2010

(86) PCT No.: PCT/DE2010/000387

§ 371 (c)(1),
(2), (4) Date: Sep. 30, 2011

(87) PCT Pub. No.: WO2010/112019

PCT Pub. Date: Oct. 7, 2010

(65) Prior Publication Data

US 2012/0018557 A1 Jan. 26, 2012

(30) Foreign Application Priority Data

Apr. 4, 2009 (DE) ..... 10 2009 016 405
Mar. 27, 2010 (DE) ..... 10 2010 013 154

(51) Int. Cl.
*B02C 21/02* (2006.01)

(52) U.S. Cl.
CPC ..... *B02C 21/026* (2013.01)
USPC ..... 241/101.74

(58) Field of Classification Search
USPC ..... 241/101.71, 101.74, 101.741
See application file for complete search history.

(56) References Cited

FOREIGN PATENT DOCUMENTS

| | | | |
|---|---|---|---|
| AT | 388968 | B | 9/1989 |
| CA | 2663177 | A1 | 3/2008 |
| DE | 2834987 | A1 | 2/1980 |
| DE | 8900072 | U1 | 3/1989 |
| DE | 3936681 | A1 | 5/1990 |
| DE | 10314958 | A1 | 3/2005 |
| DE | 10 2006 059 876 | A1 | 7/2008 |
| WO | 02/092231 | A1 | 11/2002 |
| WO | 2008/032057 | A2 | 3/2008 |

*Primary Examiner* — Mark Rosenbaum
(74) *Attorney, Agent, or Firm* — McGlew and Tuttle, P.C.

(57) ABSTRACT

A mobile crusher (2) is provided that can be displaced on four caterpillars and that includes a supporting frame (20), a large hopper (31), an apron conveyor (32), a sizer (34) and an intermediate conveyor (36) for use in strip-mining. The material is received by the shovel (1) of a shovel excavator or a wheel loader, is fed to the crusher (2), crushed and is then transferred onto a conveyor plant via a discharge conveyor system. The crusher (2) has to follow at the same cycle in which the shovel excavator moves forward during an advance in mining. In order to obtain a good maneuverability of the crusher (2), the two front caterpillars (22) are driven and can be steered like a two-caterpillar chassis. As the crusher (2) is subject to high loads, all components have to have a robust design. For this purpose, the individual functional groups are accommodated in a stable supporting frame (20). The crushed material is transferred onto a subsequent bench conveyor via an evolving conveyor directly connected to the mobile crusher (2), a transfer conveyor or a mobile bridge. The plant can be displaced while under full useful load.

20 Claims, 3 Drawing Sheets

MOBILE CRUSHER

CROSS REFERENCE TO RELATED APPLICATIONS

This application is a United States National Phase application of International Application PCT/DE2010/000387 and claims the benefit of priority under 35 U.S.C. §119 of German Patent Application DE 10 2009 016 405.7 filed Apr. 4, 2009 and German Patent Application DE 10 2010 013 154.7 filed Mar. 27, 2010, the entire contents of which are incorporated herein by reference.

FIELD OF THE INVENTION

The present invention pertains to a mobile crusher that can be displaced on four caterpillars (also known as caterpillar chassis, crawler undercarriages and continuous track chassis) and that has a supporting frame, a receiving hopper, a hopper transfer belt conveyor, a crusher (crusher unit) and an intermediate conveyor for use in strip mining. The material is received by a shovel excavator or wheel loader, fed to the crusher, crushed there and then transferred onto a downstream conveyor belt unit via a discharge conveyor system with transfer conveyor or with a mobile bridge. The term "material" is defined as material to be conveyed that is conveyed away as inorganic raw material or waste after the crushing.

BACKGROUND OF THE INVENTION

A mobile crusher, which can be displaced on a two-caterpillar chassis with short distance between the caterpillars and therefore needs an additional support under the receiving hopper, is known from the document AT 388 968 B. The distance between the receiving hopper and the direct transfer of the pulverized material onto the pivotable loading belt is relatively short. A continuous crusher, which is arranged directly above a chain scraper, is used as the pulverizing unit.

A mobile crusher, in which the superstructure in one embodiment cannot be displaced pivotably on two longitudinal caterpillars and is not supported under the receiving hopper, is, moreover, known from the document DE 103 14 958 A1. In another embodiment, a six-caterpillar chassis is used for the displaceability of the crusher. The pivotable superstructure is supported under the receiving hopper in the crusher operation.

A long apron conveyor, a double-roll crusher/sizer and a direct feed onto the loading belt is each provided in the two known solutions described above.

A mobile crusher that can be displaced on two caterpillars with a pivotable superstructure is known, furthermore, from the document DE 28 34 987. The receiving hopper and the apron conveyor can be raised and lowered via a hydraulic cylinder. The superstructure is additionally supported in the crusher operation to reduce the hopper forces through the impacting material.

The material is conveyed from the receiving hopper to the crusher/sizer via an apron conveyor. The crushed material is then taken over by an intermediate conveyor and transferred to a pivotable loading belt.

A mobile crusher with a pivotable superstructure, whose receiving hopper is supported at the base during the operation, in which, however, an intermediate conveyor is used between the double-roll crusher/sizer and the pivotable loading belt, is likewise disclosed in the document WO 02/092231 A1. A plurality of units of this design are in operation.

The solutions described above have either a very short overall length, which keeps the range between material pickup and material discharge short, or they have a complicated design, are heavy or cost-intensive.

Changes in the basic structure of the crusher of the solution described according to the document WO 02/092231 A1 and the embodiment of structural components in different variants are known from the comprehensive document WO 2008/032057 A2, in which are summarized seven priority-establishing individual inventions. Such structural components concern the support of the receiving hopper, the arrangement and pivotability of the rear boom, the sometimes additional use of an intermediate conveyor, the additional support of the crusher superstructure and the use of different caterpillar chassis as well as the arrangement of the individual caterpillars and their distance to one another.

In another document DE 10 2006 059 876 A1, the support under the receiving hopper of a mobile crusher is improved in a way that lateral impacts from the impact impulse are led directly into the support foot. Thus, damage in the main framework of the crusher is avoided.

SUMMARY OF THE INVENTION

A basic object of the present invention is to simplify the overall system of the mobile crusher and at the same time to guarantee the continuation of the unit without interrupting the material flow. The conveying of material between the crusher and the face conveyor arranged downstream in the direction of conveying is carried out either by a relatively long pivoting belt, connected directly to the crusher unit, or by a separate bridge or a separate transfer conveyor. The crusher can be used in multistep operation by means of the bridge or the transfer conveyor.

For this, the device is to be designed such that the dead lengths at the head and rear of the mining faces are to be bridged over thoroughly.

According to the invention, a mobile crusher is provided comprising four-caterpillar chassis, a supporting frame, a receiving hopper, an apron conveyor, a crusher/sizer and an intermediate conveyor. The supporting frame of mobile crusher comprises a framework with two side panels as well as lower and upper cross-ties. Under the feed side for the material to be crushed, the supporting frame is provided with a cross-box, at which the two rear longitudinal chassis are mounted via a long caterpillar axle or two short caterpillar axles on the outside. The rear longitudinal caterpillars are not controlled and have no drives, they are equipped with four-wheel rockers and two-wheel rockers for the uniform distribution of loads on the wheels. Under the loading side, the supporting frame is supported on the front two-caterpillar chassis by means of a ball and socket joint. The front caterpillars are connected to one another by means of a triangular crossbeam, to which one caterpillar is rigidly connected and the other caterpillar is movably connected via an axle. The front caterpillars can be controlled like a two-caterpillar chassis and they can be rotated into any direction in relation to the support structure, they have powerful drives and are equipped with four-wheel rockers and two-wheel rockers for the uniform distribution of loads on the wheels. The distance between the front and rear sets of caterpillars is deliberately selected to be great to keep the load change on the caterpillars as small as possible because of the large hopper load. All four chassis of the crusher unit are dimensioned so that displacement with full load capacity can take place in the hopper, on the apron conveyor and on the intermediate conveyor. The receiving hopper and the apron conveyor are integrated firmly in the supporting frame. The sizer (crusher/sizer) is placed on the supporting frame and can be easily driven out of the working position into a service position in the direction of the discharge side. The intermediate conveyor, between crusher/sizer and the material discharge is integrated firmly in the supporting frame. The containers for the electrical systems as well as the grease lubricating system of the crusher are arranged easily accessibly next to the lower panel of the supporting frame.

The mobile crusher has a stable supporting frame, which is carried by two longitudinally arranged oscillating caterpillars under the receiving hopper and the hopper transfer belt conveyor, as well as a double caterpillar, which can be controlled like a two-caterpillar chassis, under the intermediate conveyor.

A receiving hopper, a hopper transfer belt conveyor designed as an apron conveyor, a double-roll crusher/sizer and an intermediate conveyor are arranged behind one another in the direction of conveying on the supporting frame.

The four-caterpillar chassis of the described arrangement generally makes possible a longitudinal displacement of the crusher and only needs a slight width when driving on ramps and berms. The complete rotation of the double caterpillar under the intermediate conveyor produces an optimal displaceability of the device, including turning.

The longitudinal position of the crusher unit and long length because of the intermediate conveyor is advantageous in case of material mining at the face ends.

The great distance between the rear pair of caterpillars and the front double caterpillar makes sure that the highly variable loads in the receiving hopper and on the hopper transfer belt conveyor cause only relatively small load changes in the caterpillars. The entire crusher unit is only carried by the 4 caterpillars even during operation. A displacement is consequently possible with full load capacity.

The stable supporting frame integrates a box for the caterpillar axle or the two caterpillar half axles of the two rear caterpillars. In this way, the forces from the impact of the material, which falls from the shovel of the shovel excavator, and the hopper load are led directly into the caterpillar carriers. Because of the oscillating caterpillar connection as well as the four-wheel and two-wheel rockers, the load is distributed uniformly onto all running wheels of the caterpillars. This reduces the loads of components to a minimum.

The pair of caterpillars under the intermediate conveyor is connected to the supporting framework via a universal ball joint. This leads to an optimal balance of the forces even on uneven ground and provides for as uniform wheel loads as possible together with the caterpillar axle as well as the two-wheel and four-wheel rockers used.

The supporting frame integrates the receiving hopper, hopper transfer belt conveyor and intermediate conveyor at the same time. It carries the double-roll crusher/sizer and all other functional components.

The receiving hopper, which can accommodate the contents of approx. 2½ shovels, and the hopper transfer belt conveyor are fully integrated in the supporting frame.

The hopper transfer belt conveyor may be designed as being relatively short, because the crusher/sizer is arranged in a low position on the supporting frame. This is consequently possible because the intermediate conveyor under the crusher/sizer can be arranged in a low position within the supporting frame. It lies directly above the flat connection construction between the two sets of caterpillars.

The crusher/sizer lies on the supporting framework and can be arranged both at right angles and axially parallel to the hopper transfer belt conveyor. It can be moved out for service in the direction of the loading belt under the crusher intake hood.

The intermediate conveyor conveys the crushed material from the receiving chute under the crusher/sizer to the discharge site. At the same time, it is led so high that there is enough space for transfer to the discharge conveyor system arranged downstream. As a result, it is also possible that a mobile bridge, arranged downstream, can be supported directly under the transfer.

The intermediate conveyor has a large belt width and runs at low speed. As a result, the feed stream coming from the crusher is evened out.

A rear boom, which can be both pivoted and raised and lowered, may be connected at the end of the intermediate conveyor. The eccentric torque of the rear boom is compensated by a ballast arranged above or below. This is especially important when the rear boom is relatively long in case of direct feeding onto the conveyor belt unit. Torsional loads of the supporting framework are consequently largely avoided.

For achieving a large overall mining width or for mining in multistep operation, a mobile bridge or a transfer conveyor is used between the mobile crusher unit and the conveyor belt unit arranged downstream.

The combination of a mobile crusher unit without pivoting belt and a mobile bridge is particularly advantageous. Herein, the number of conveyor belts is minimized, which keeps the operating costs low. Moreover, the mobile bridge optimally bridges over the operating ramps needed for the up and down steps.

Further details and advantages of the subject of the present invention arise from the following description and the pertinent drawings, in which a preferred exemplary embodiment is shown. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
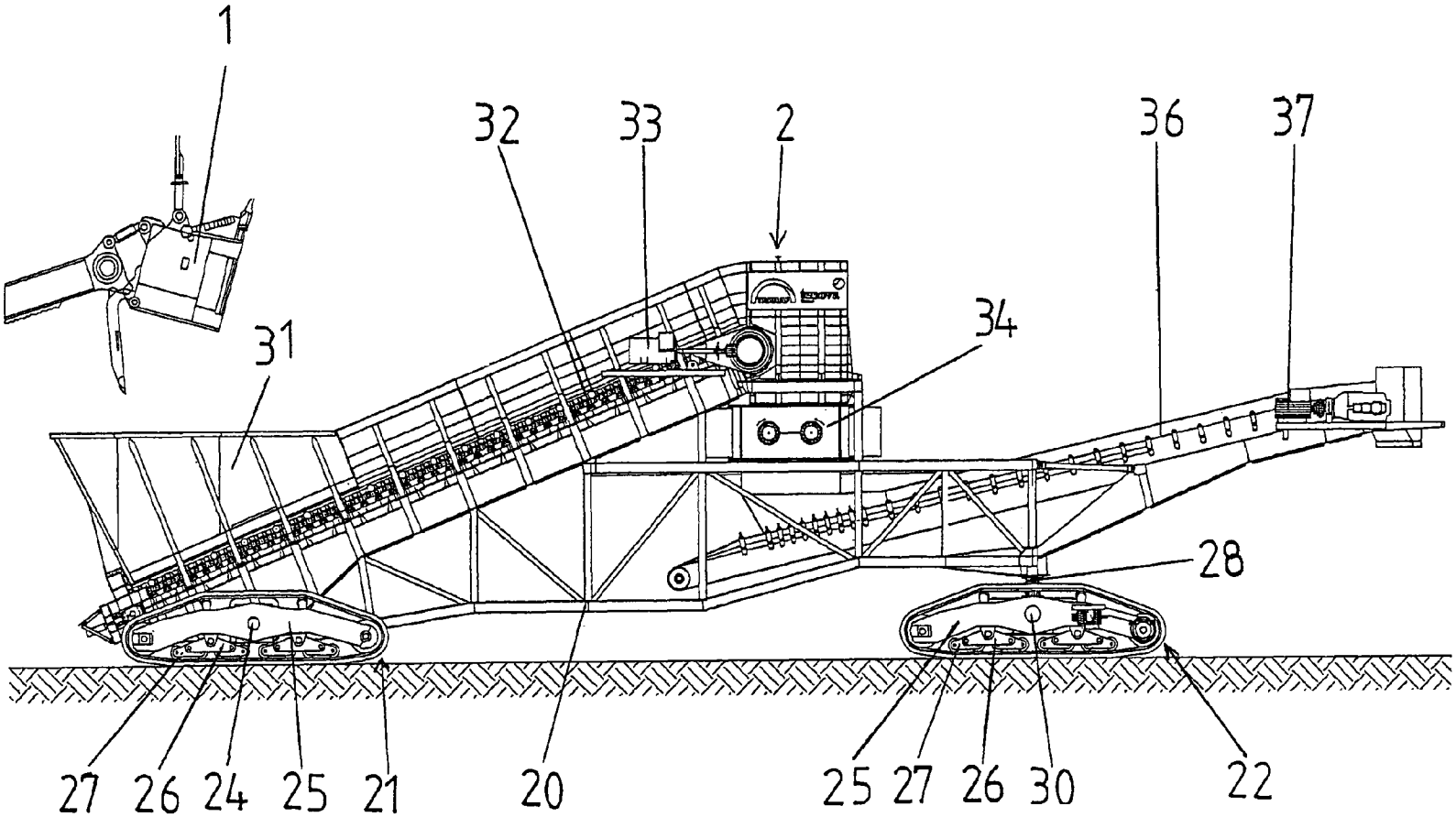
FIG. 1 is a lateral view showing a mobile crusher without pivoting belt.

Referring to the drawings in particular, according to FIG. 1, material is fed from the shovel 1 of a shovel excavator to the mobile crusher 2, pulverized by same to a conveyable size and then transferred to a transfer conveyor (not shown) or a mobile bridge (likewise not shown) for further conveying to the face conveyor. In this case, the mobile crusher 2 and the conveyor arranged downstream are moved further progressively with the mining progress of the shovel excavator.

The mobile crusher 2 consists of a stable supporting frame 20, which is carried by the two rear longitudinal caterpillars (crawlers) 21 and the two front longitudinal caterpillars (crawlers) 22. The supporting frame 20 includes two vertical support panels arranged parallel to one another, which together with lower and upper cross-ties form a stable construction.

A stable crossbeam 23, which accommodates a long, continuous caterpillar axle 24, is integrated in the rear, lower part of the supporting frame 20. As an alternative to a long caterpillar axle 24, two short caterpillar half axles may also be used. Caterpillar carriers 25 with four-wheel rockers 26 and two-wheel rockers 27 are placed onto the caterpillar axle 24 on both sides.

The rear longitudinal caterpillars 21 are not provided with drives.

The front part of the supporting frame 20 is supported on a two-caterpillar chassis 29 via a support ball (ball and socket joint) 28. A static, defined three-point support without constraining forces is formed as a result. One of the front caterpillars 22 is connected to the crossbeam between the caterpillars 22 of the two-caterpillar chassis 29, and the other caterpillar 22 is connected via a caterpillar axle 30. As a result, a complete load distribution is also provided with this embodiment. The two front caterpillars 22 are each provided with a powerful drive and can be moved like a two-caterpillar chassis. The front two-caterpillar chassis 29 can move in any direction and can bring the mobile crusher 2 in any desired position. This is especially important for turning from one direction of travel into the other.

The distance between the rear caterpillars 21 and the front caterpillars 22 is deliberately selected to be long. Thus, the rear pair of caterpillars 21 lies far below the receiving hopper 31 and the apron conveyor 32. The forces from the material impact and the hopper contents are led directly into the caterpillars 21 located under it.

Beginning from the left in the direction of conveying, the supporting frame 21 accommodates the receiving hopper 31, the apron conveyor 32 with the drives 33, the material pulverizer designed as a sizer 34 with the drives 35, and the intermediate conveyor 36 with the drives 37. From discharge of the intermediate conveyor 36, the material is conveyed to the face conveyor via a transfer conveyor (not shown) or a mobile bridge (not shown).

Figure 3:
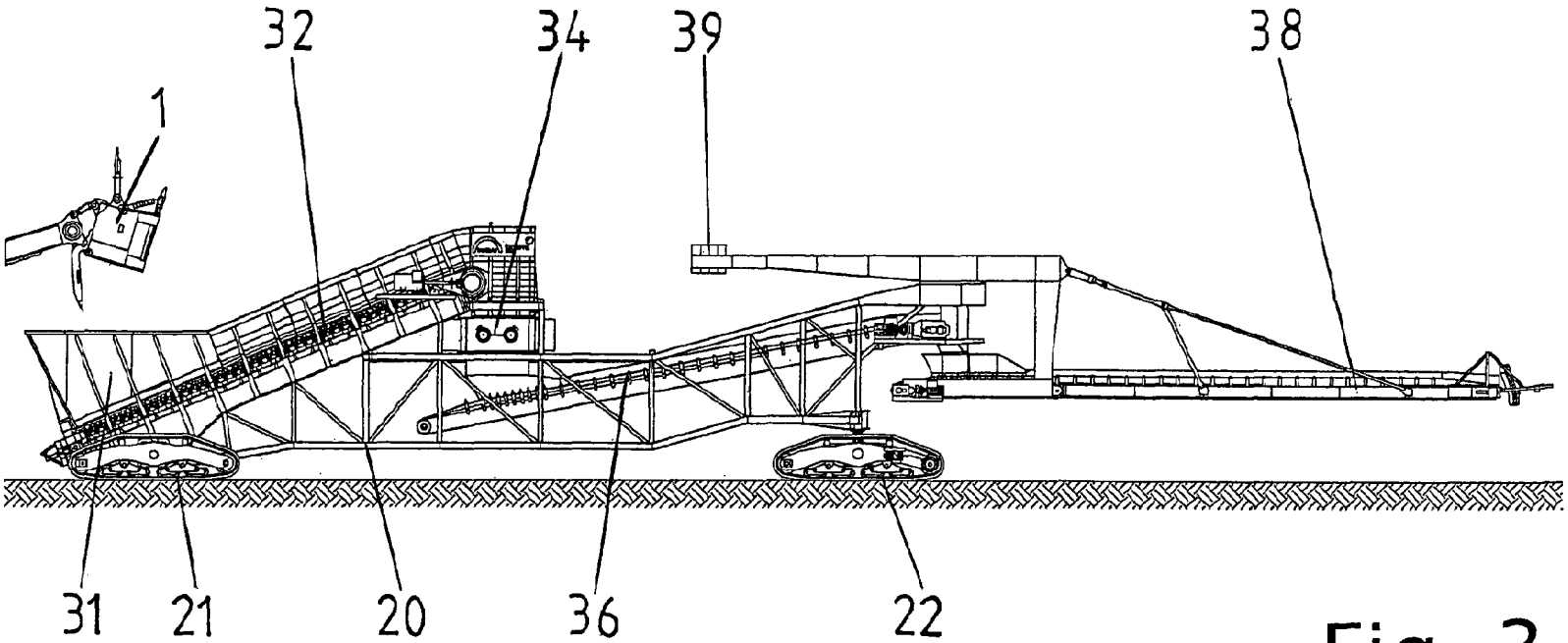
FIG. 3 is a lateral view showing the mobile crusher with pivoting belt in a lateral view.

As an alternative, the further conveying may also be done by means of a pivoting belt 38 shown in FIG. 3. The pivoting belt 38 may be used as a bridge to a transfer conveyor. However, it may also have a longer design and feed the material directly onto the face conveyor. The eccentricity of the pivoting belt 38 can be compensated by a counterweight 39 in both cases.

Figure 2:
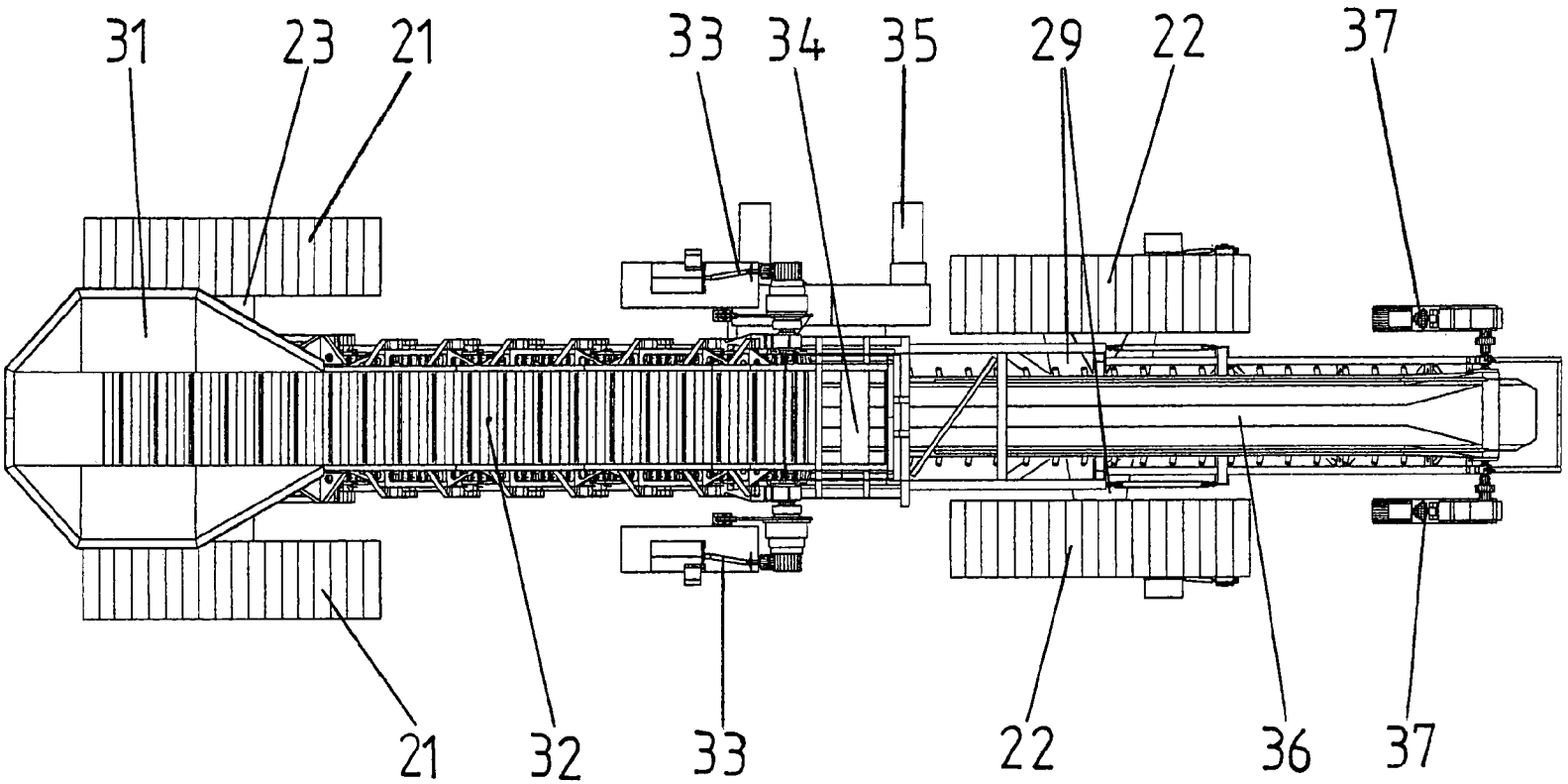
FIG. 2 is a top view showing the mobile crusher according to FIG. 1.

Basically the features described based on FIGS. 1 and 2 apply to the device structure according to FIG. 3.

The receiving hopper 31 is dimensioned, such that it may accommodate the material quantity of 2½ contents of the shovel 1 of the shovel excavator.

Another crusher, e.g., a double-roll crusher may also be used instead of a sizer 34.

The receiving hopper 31 and apron conveyor 32 are fully integrated in the stable construction of the supporting frame 20. The apron conveyor 32 may be designed as relatively short, because the sizer 34 is arranged on the supporting frame 20 in a low position. This is consequently possible because the intermediate conveyor 36 can in turn be arranged in a low position under the sizer 34 within the supporting frame 20. It lies directly above the lower connection construction of the supporting frame 20.

Sizer 34 lies on the supporting frame 20 and can be arranged both at right angles and axially parallel to the apron conveyor 32. It is arranged displaceably on rails on the supporting frame 20 and can be moved as needed for performing service work after loosening the rigid connection to the supporting frame 20 into a position freely accessible for the service work in the direction of material discharge.

The crushed material is transported by the intermediate conveyor 36 from the sizer 34 for further conveying by means of a pivoting belt 38, a transfer conveyor (not shown) or a mobile conveying bridge (not shown). At the same time, it is led so high that there is enough space for the transfer to the further conveyor. The intermediate conveyor 36 is designed with great width and low speed and it evens out the feed stream.

Raising and re-lowering of the hopper 31 is not needed when displacing the crusher with the mining progress of the shovel excavator from one operating position into the next one. As a result, the time for the displacement can be minimized. This is especially important when, instead of a wide block with travel of the shovel excavator about the receiving hopper 31, a plurality of narrow lateral blocks with parallel travel of the shovel excavator double-roll crusher are mined.

The displacement process can be automated by using a Global Positioning System (GPS).

While specific embodiments of the invention have been described in detail to illustrate the application of the principles of the invention, it will be understood that the invention may be embodied otherwise without departing from such principles.

The invention claimed is:

1. A mobile crusher comprising:

four-caterpillar chassis;

a supporting frame;

a receiving hopper;

an apron conveyor;

a crusher/sizer; and an intermediate conveyor, wherein:

the four-caterpillar chassis comprises a first longitudinal caterpillar chassis and a second longitudinal caterpillar chassis under the receiving hopper and a third longitudinal caterpillar chassis and a fourth longitudinal caterpillar chassis under the intermediate conveyor;

under a feed side for the material to be crushed, the supporting frame is provided with a crossbeam, at which the first longitudinal caterpillar chassis and the second longitudinal caterpillar chassis under the receiving hopper are mounted via a long caterpillar axle or two short caterpillar axles, on the outside, wherein said receiving hopper is located between said first longitudinal caterpillar chassis and said second longitudinal caterpillar chassis;

the first longitudinal caterpillar chassis and the second longitudinal caterpillar chassis under the receiving hopper are not directionally controlled;

the third longitudinal caterpillar chassis and the fourth longitudinal chassis under the intermediate conveyor is controlled like a two-caterpillar chassis;

the four-caterpillar chassis forms a static defined three-point support with a support ball between the third longitudinal caterpillar chassis and the fourth longitudinal caterpillar chassis under the intermediate conveyor and the supporting frame; and each of the first longitudinal caterpillar chassis and the second longitudinal caterpillar chassis under the receiving hopper and the third longitudinal caterpillar chassis and the fourth longitudinal caterpillar chassis under the intermediate conveyor are dimensioned, such that the mobile crusher can be displaced with full load capacity in the receiving hopper, apron conveyor, crusher/sizer and intermediate conveyor.

2. A mobile crusher in accordance with claim 1, wherein the chassis can be controlled by automatic displacement by means of using a Global Positioning System (GPS).

3. A mobile crusher in accordance with claim 1, wherein the crusher/sizer can be arranged both longitudinally and transversely to the direction of conveying.

4. A mobile crusher in accordance with claim 1, wherein the crusher/sizer is placed on the supporting frame and can be easily driven out of a working position into a service position in a direction of a discharge side.

5. A mobile crusher in accordance with claim 1, wherein containers for electrical systems as well as grease lubricating system of the crusher are arranged easily accessibly next to a lower panel of the supporting frame.

6. A mobile crusher in accordance with claim 1, further comprising a rear boom at a discharge end of the intermediate conveyor with counterweight, the rear boom being pivotable and height-adjustable, whereby a length of the rear boom is such that material is fed directly to a downstream conveyor belt unit.

7. A mobile crusher in accordance with claim 1, wherein the intermediate conveyor between the crusher/sizer and a material discharge is integrated firmly in the supporting frame.

8. A mobile crusher in accordance with claim 1, wherein the longitudinal four-caterpillar chassis are movably connected to the supporting frame via the caterpillar axles and are equipped with four-wheel rockers and two-wheel rockers for full load distribution.

9. A mobile crusher comprising:

a receiving hopper;

an apron conveyor;

a crusher/sizer;

an intermediate conveyor;

a supporting frame comprising a framework with a cross-beam, the receiving hopper and the apron conveyor being integrated in the supporting frame; and four-caterpillar chassis comprising a set of two rear longitudinal caterpillar chassis and a set of two front longitudinal caterpillar chassis under the intermediate conveyor, the two rear longitudinal caterpillar chassis and the two front longitudinal caterpillar chassis being dimensioned, such that the mobile crusher can be displaced with full load capacity in the receiving hopper, the apron conveyor, the crusher/sizer and the intermediate conveyor, the two rear longitudinal chassis being mounted on an outside to the cross-beam via a long caterpillar axle or two short caterpillar axles, the set of two rear longitudinal caterpillar chassis not being directionally controlled, wherein a space is defined between one of said two rear longitudinal caterpillar chassis and another one of said two rear longitudinal caterpillar chassis, said receiving hopper being arranged in said space, wherein said receiving hopper is located between said one of said two rear longitudinal caterpillar chassis and said another one of said rear longitudinal caterpillar chassis, the set of two front longitudinal caterpillar chassis being directionally controlled like a two-caterpillar chassis, the set of two front longitudinal caterpillar chassis being together connected by a support ball to the supporting frame whereby the four-caterpillar chassis form a static defined three-point support.

10. A mobile crusher in accordance with claim 9, wherein the four-caterpillar chassis is controlled by automatic displacement by means of using a Global Positioning System (GPS).

11. A mobile crusher in accordance with claim 9, wherein the crusher/sizer is movable for being arranged both longitudinally and transversely to a direction of conveying, at least a portion of each of said two rear longitudinal caterpillar chassis being located at under the receiving hopper.

12. A mobile crusher in accordance with claim 9, wherein the crusher/sizer is connected on the supporting frame for being moved out of a working position into a service position in a direction of the material discharge.

13. A mobile crusher in accordance with claim 9, further comprising a rear boom at a discharge end of the intermediate conveyor with counterweight, the rear boom being pivotable and height-adjustable, whereby a length of the rear boom is such that material is fed directly to a downstream conveyor belt unit.

14. A mobile crusher in accordance with claim 9, further comprising:

containers for electrical systems as well as grease lubricating system arranged accessibly next to a lower portion of a side panel of the supporting frame.

15. A mobile crusher in accordance with claim 9, wherein the intermediate conveyor is positioned between the crusher/sizer and a material discharge and said intermediate conveyor being integrated in the supporting frame.

16. A mobile crusher in accordance with claim 9, wherein each of said two rear longitudinal caterpillar chassis and the two front longitudinal caterpillar chassis is movably connected to said support frame and each of said two rear longitudinal caterpillar chassis and said two front longitudinal caterpillar chassis having four-wheel rockers and two-wheel rockers for full load distribution.

17. A mobile crusher comprising:

a receiving hopper;

an apron conveyor;

a crusher/sizer;

an intermediate conveyor;

a supporting frame comprising a framework with a cross-beam, the receiving hopper and the apron conveyor being integrated in the supporting frame; and a four-crawler chassis comprising a set of two rear longitudinal crawlers and a set of two front longitudinal crawlers under the intermediate conveyor, said set of two rear longitudinal crawlers comprising a first rear crawler and a second rear crawler, said first rear crawler being located on one side of said receiving hopper, said second rear crawler being located on another side of said receiving hopper, wherein said one side is located opposite said another side, at least one portion of said receiving hopper being located adjacent to said first rear crawler, at least another portion of said receiving hopper being located adjacent to said second rear crawler, wherein said receiving hopper is located between said first rear crawler and said second rear crawler, said set of two front longitudinal crawlers comprising a first front crawler and a second front crawler.

18. A mobile crusher in accordance with claim 17, wherein the two rear longitudinal crawlers and the two front longitudinal crawlers are dimensioned, such that the mobile crusher can be displaced with full load capacity in the receiving hopper, the apron conveyor, the crusher/sizer and the intermediate conveyor, the two rear longitudinal crawlers being mounted on an outside to the cross-beam via a long crawler axle or two short crawler axles, the set of two rear longitudinal crawlers not being directionally controlled, the set of two front longitudinal crawlers chassis being directionally controlled like a two-crawler chassis, the set of two front longitudinal crawler chassis being together connected by a support ball to the supporting frame whereby the four-crawler chassis forms a static defined three-point support.

19. A mobile crusher in accordance with claim 17, wherein said first rear crawler comprises a first rear crawler endless track, said second rear crawler comprising a second rear crawler endless track, said at least one portion of said receiving hopper being located adjacent to said first rear crawler endless track, said at least another portion of said receiving hopper being located adjacent to said second rear crawler endless track.

20. A mobile crusher in accordance with claim 19, wherein a bottom portion of said receiving hopper is located between said first rear crawler endless track and said second rear crawler endless track.

* * * * *